United States Patent [19]

Nilsson et al.

[11] 4,088,062

[45] May 9, 1978

[54] FLUID PRESSURE OPERATED IMPACT MECHANISM

[76] Inventors: Göran Alfred Nilsson, 820 22 Sandarne; Kjell Edström, Asbacksgatan 45, 82600 Soderhamn; Henry Wiklund, Backvagen 1, 820 10 Arbra, all of Sweden

[21] Appl. No.: 673,308

[22] Filed: Apr. 2, 1976

[30] Foreign Application Priority Data

Apr. 7, 1975 Sweden ..... 7503970

[51] Int. Cl.[2] ..... F01L 21/02

[52] U.S. Cl. ..... 91/50; 91/325; 91/335

[58] Field of Search ..... 91/234, 325, 402, 395, 91/399, 50; 92/85 R

[56] References Cited

U.S. PATENT DOCUMENTS

| | | | |
|---|---|---|---|
| 1,707,259 | 4/1929 | Farmer | 91/402 |
| 1,780,817 | 11/1930 | Dubois | 91/50 |
| 2,119,285 | 5/1938 | Morgan | 91/234 |
| 2,277,491 | 3/1942 | Huber | 91/50 |
| 2,624,320 | 1/1953 | Williams | 91/402 |
| 2,642,845 | 6/1953 | Stevens | 91/395 |
| 2,781,742 | 2/1957 | Poole | 91/234 |
| 3,329,068 | 7/1967 | Klaus | 92/85 R |

*Primary Examiner*—Paul E. Maslousky
*Attorney, Agent, or Firm*—Eric Y. Munson

[57] ABSTRACT

A fluid pressure operated impact mechanism of the type having a reciprocating working member guided for movement along an axis toward and away from a stop member, a pressure chamber between the working and stop members to receive a fluid pressure medium to exert forces separating the two members, and pressure sealing means for maintaining the pressure chamber sealed as the working member and stop member separate. The mechanism is characterized by a sealing arrangement which requires few precision parts yet is applicable to a variety of different devices. In the sealing arrangement, the pressure chamber is formed in the surface of at least one of the members, so that the two members meet along a separating line at the periphery of the pressure chamber. One of the members forms a support wall or flange extending in an axial direction along the separating line, and a flexible sealing means extends from the support wall of the one member to the other member, thereby effecting a seal therebetween. The sealing means is supported radially against the outward force of the pressure medium by the support wall, and is arranged to be elastically deformed in the axial direction by the pressure medium, thereby to maintain the pressure chamber sealed as the working member separates from the stop member. When the limit of deformation is reached and the seal is broken, the sealing means elastically returns to its relaxed condition to vent the pressure medium from the chamber and to permit the working member to reciprocate back toward the stop member to again form a seal therebetween. The sealing means, which can be an O-ring or bellows, preferably has an axial dimension when relaxed of just less than twice the axial height of the support wall.

10 Claims, 12 Drawing Figures

FIG. 10
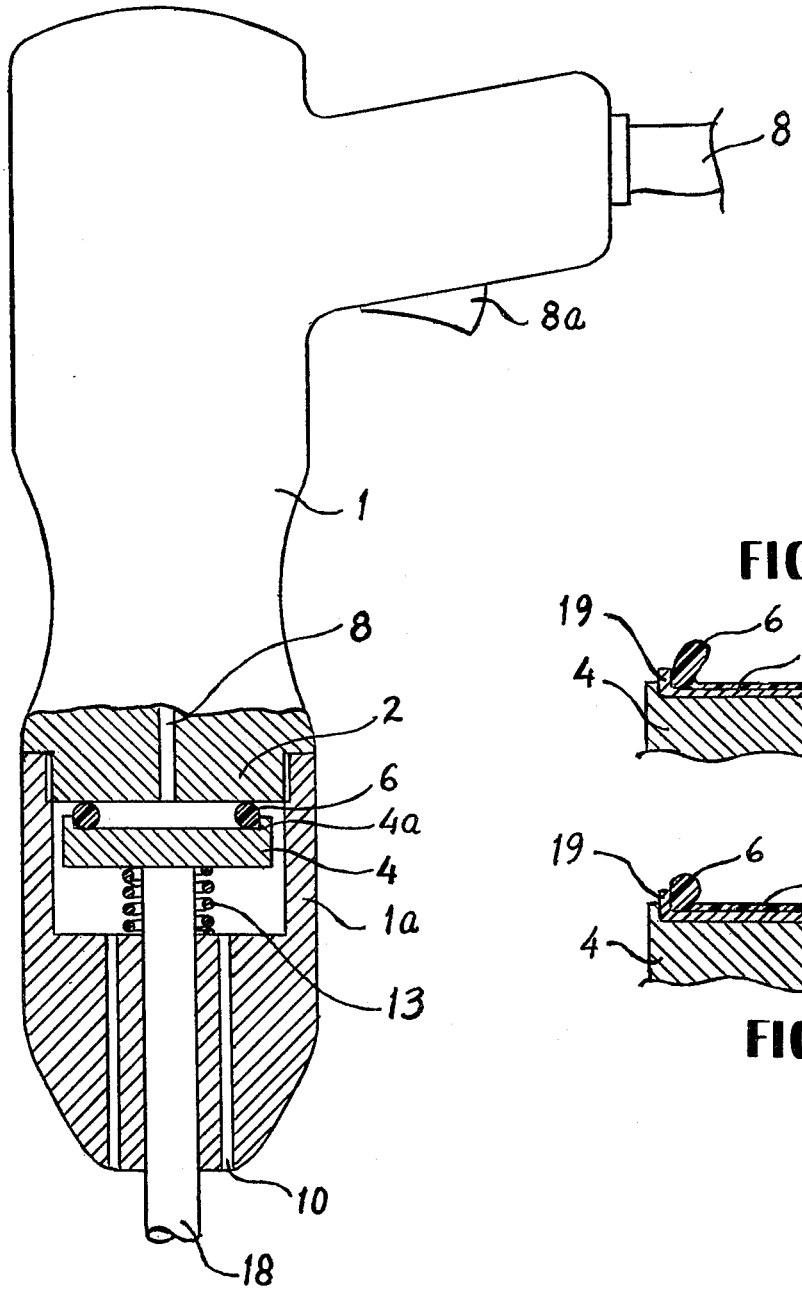
FIG. 11
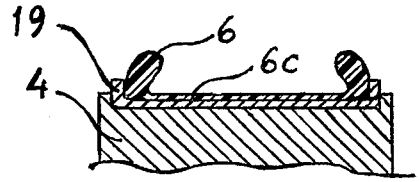
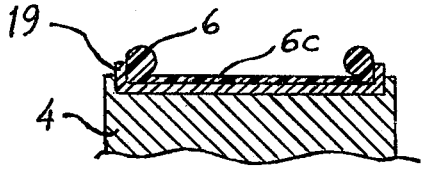
FIG. 12

FLUID PRESSURE OPERATED IMPACT MECHANISM

BACKGROUND OF THE INVENTION

1. Field of the Invention

This invention relates to fluid pressure operated impact mechanisms of the type having reciprocating members moved by introducing a pressure medium into a pressure chamber at one side of the reciprocating member, and relates more particularly to sealing arrangements for maintaining the pressure chamber in a sealed condition during motion of the reciprocating member. Impact mechanisms of the reciprocating-motion, fluid pressure operated type to which this invention relates include devices for pile and sheet pile driving, for drilling, chiseling, marking and hammering, for vibrating screens, feeder pans, and similar devices, and for compacting ballast, or the like.

2. Description of the Prior Art

A variety of reciprocating-motion, fluid pressure operated devices are known. A typical example is a fluid pressure operated hammer used for pile driving and made in the form of a piston-and-cylinder device, the impact force being produced by lifting the piston with a pressure medium acting on its bottom surface, and then dropping the piston against a stop plate, which may comprise one of the cylinder end walls. To accomplish such lifting and dropping, an impulse generating and valving system is required for alternate delivery and discharge of the pressure medium to a chamber under the piston. Further, to avoid energy losses, good sealing is required between the piston and cylinder. These features require parts manufactured with considerable precision, which will be expensive. Due to such demands for precision, it is particularly expensive to make a piston-and-cylinder device with a large diameter in order to obtain a large pressure area, and large lifting force, for the piston. Piston-and-cylinder devices also face problems because of the interaction between the piston guiding means and the pressure medium. The pressure medium tends to expel lubricant from between the piston and cylinder wall and, in addition, contaminants in the pressure medium can damage the guiding surfaces along the cylinder walls.

As a result of these considerations, present reciprocating motion, fluid pressure operated devices of this type are not entirely satisfactory.

SUMMARY OF THE INVENTION

The present invention provides an impact mechanism which is free from the above-mentioned disadvantages of existing devices, being capable of realization without expensive precision parts and of operating without harmful effects upon the means provided for guiding the reciprocating member. The construction of the impact mechanism, moreover, is applicable to devices of different sizes, different stroke lengths, and different frequencies of operation.

In a preferred embodiment of the invention to be described hereinbelow in detail, the fluid pressure operated impact mechanism is characterized by a sealing arrangement in which sealing takes place directly between the reciprocating working member and the stop member toward and away from which the working member moves, rather than between the working member and a surface along which the working member slides. The pressure chamber is arranged between the working member and stop member, which meet along a separating line at the periphery of the pressure chamber. One of the members forms a support wall or flange extending in the axial direction, and a flexible sealing means extends from the support wall or flange to the other member along the separating line and is pressed radially by the outward component of the force of the pressure medium against the support wall or flange. The sealing means, for example a rubber circular member, is elastically deformable in the axial direction when acted on by the pressure medium, thereby maintaining a seal between the working member and stop member as they begin to separate. When the working and stop members separate far enough to exceed the elastic limit of the sealing means and break the seal, the sealing means elastically returns to its relaxed condition to vent the pressure medium from the chamber to permit the working member to reciprocate back toward the stop member to reform a seal for the pressure chamber. In other aspects of the invention, the sealing means may be formed with a base plate held by fluid pressure to the member having the support wall or flange, and may be made, for example, in the form of a bellows.

Due to the above characteristics, no special impulse generating or valve system is needed for a device in accordance with the invention and, further, the sealing problem has been solved in a very simple and cheap way which does not interfere with the guiding mechanism or present problems with contaminants in the pressure medium. Therefore, devices can be manufactured even with very large dimensions for obtaining a great impact force without being too expensive due to precision demands. Neither is it necessary, as is the case with conventional piston-and-cylinder devices, to use only a circular cross section for the member corresponding to the piston, but the working member may very well be square or rectangular.

Other objects, aspects and advantages of the invention will be pointed out in, or apparent from, the detailed description hereinbelow considered together with the following drawings.

DESCRIPTION OF THE DRAWINGS

FIG. 10 is an elevational view, partly in section, of still another embodiment of the invention; and FIGS. 11 and 12 are partial sectional elevations of additional sealing arrangements in accordance with the present invention.

DESCRIPTION OF THE PREFERRED EMBODIMENTS

Figure 1:
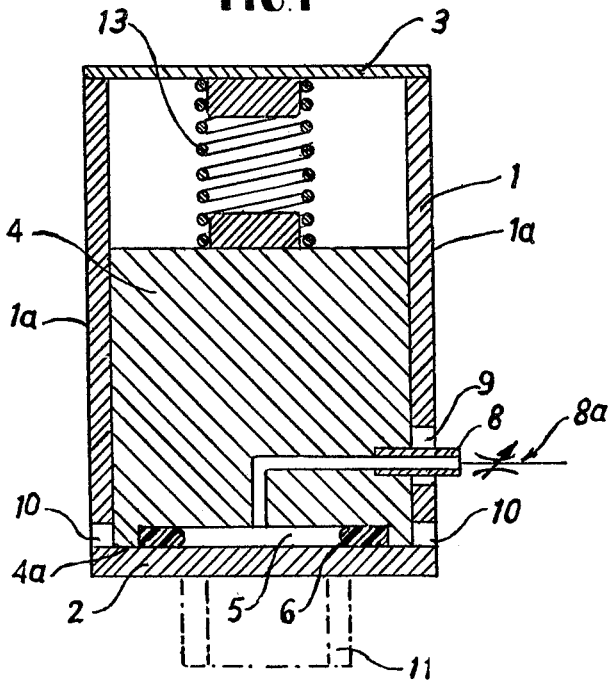
FIG. 1 is a sectional elevation of an impact mechanism constructed in accordance with the present invention.
Figure 2:
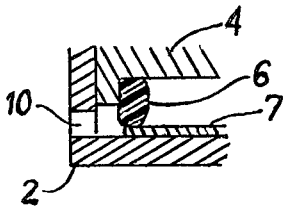
FIGS. 2 and 3 are detailed sectional views of the mechanism of FIG. 1, showing the mechanism in different stages of operation.
Figure 3:
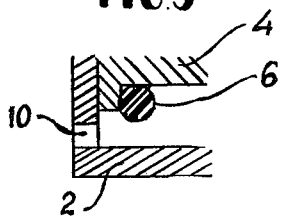

Referring to the drawing, FIGS. 1, 2 and 3 show an impact mechanism comprising a cylinder 1 with a mantle la, a bottom plate 2 and a cover 3. In the cylinder is a working member or plunger 4, which at its end closest to the plate 2 is provided with a flange 4a enclosing a chamber or cavity 5 under the plunger and meeting the plate 2 along a separating line at the periphery of the cavity. A ring-shaped seal 6, which may for example consist of a rubber O-ring or a strong rubber hose and which has an outer diameter substantially corresponding to the inner diameter of the flange 4a, is fitted in the cavity 5 against the flange. The seal 6 can be glued or otherwise fixed to the inner wall of the flange and/or the bottom of the plunger 4. The thickness of the seal 6 in its unloaded or relaxed condition (FIG. 3) should preferably be somewhat less than twice the axial height of flange 4a, i.e., just less than twice the distance between the bottom of the plunger (i.e., the "ceiling" of the cavity 5), and the plate 2 when the plunger is resting with its flange 4a against the bottom plate.

A conduit 8 for introducing compressed air or another pressure fluid leads from the side of the plunger to the cavity 5 under it. From the side of the plunger the conduit continues through a slotted opening 9 in the cylinder. As illustrated in FIG. 1, the conduit can be fitted with a valve 8a for adjustment of the amount of pressure medium introduced per time unit. At the same time the valve 8a may serve as a start and stop means for the supply of pressure medium, or a separate device (not shown) can be provided for this purpose. In the cylinder wall, close to the bottom plate 2, a number of spaced exhaust or vent holes 10 are provided. The impact device of FIG. 1 is suitable for use as a pile driver, and an attachment 11 is indicated in dashed lines for fitting the device to a pile or the like. A pressure spring 13 is fitted between the plunger 4 and the cover 3, but the device may also be made without this spring if the working member or plunger 4 is to be returned against the plate 2 only through the force of gravity.

The operation of the impact mechanism shown in FIGS. 1, 2 and 3 is as follows: Compressed air or another pressure medium from a source (not shown) is delivered to the cavity 5 through the conduit 8. The amount per time unit of pressure medium supplied is adjusted by throttling the conduit with the help of the valve 8a. Due to the pressure acting against the bottom of the plunger 4, the plunger starts to lift. The seal ring 6, which is compressed between the plunger and the bottom plate when the plunger is in the rest position (FIG. 1), will, during the first phase of the lifting movement of the plunger (FIG. 2), maintain contact with the plate and seal against it. This occurs because the seal, due to its flexibility and the fluid pressure acting radially against it and pressing it against the flange 4a, will deform and expand axially, i.e., downwards (See FIG. 2). When, during the next phase, the plunger reaches a certain height above plate 2, the seal will suddenly lose contact with the plate 2 and quickly snap back upwards (FIG. 3) because of its now being subjected to pressure on its bottom side by the escaping air and also, if the seal has been deformed to a larger vertical dimension than its unloaded condition, by its contracting due to its elasticity. The air in chamber 5 escapes through the vent holes 10 in the cylinder wall, while the plunger, due to the velocity imparted to it, continues upwards another short distance before, during the next phase, it reverses and falls, by gravity or the influence of one or more springs 13, towards the plate 2. This results in the closing of the outlet openings 10 and the compression of the seal 6. The cycle of lifting and falling of the plunger is then repeated until the supply of pressure medium is shut off. When the plunger moves, the air conduit 8 will, in the embodiment shown in FIG. 1, move up and down in the slot 9.

Figure 4:
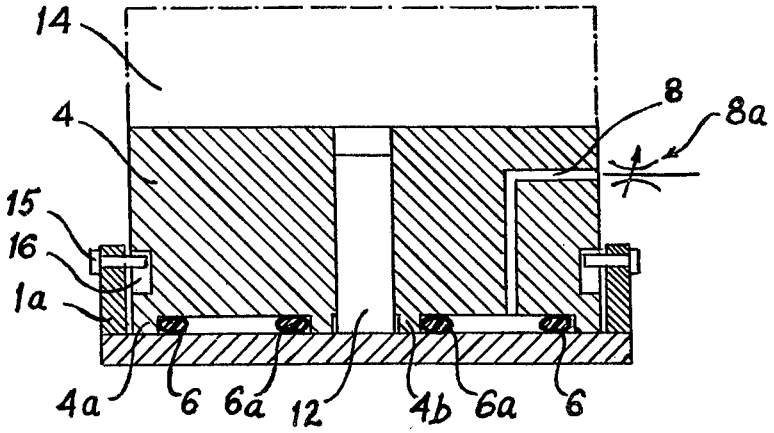
FIG. 4 is a sectional elevation of another embodiment of the invention.

FIG. 4 shows another embodiment of the invention wherein the working member or plunger 4 is guided axially, not by a cylinder wall, but by a shaft 12 arranged centrally in it. The plate 2 is fitted with a number of axially oriented members 1a, provided with bolts or the like 15 engaging in openings 16 in the sides of the working member 4 in order to limit its axial movement in relation to the plate 2, thus preventing the device from falling apart, e.g. when being handled during transport. As indicated by dash-and-dot lines, it is possible to add one or more additional weights 14 to the working member 4. This possibility of dividing the device into several parts makes it easier to lift and handle. In addition to the outer seal ring 6 and the flange 4a there are also an inner seal 6a and a flange 4b around the shaft 12, whereby sealing against the shaft and improved distribution of the impact force of the working member 4 against the plate 2 are obtained. The pressure medium is supplied via the conduit 8 to the ring-shaped cavity formed between the seals 6 and 6a. Since, apart from the side members 1a, the device can be entirely open towards the sides, no special outlet openings (such as vents 10 in FIG. 1) are needed.

Figure 5:
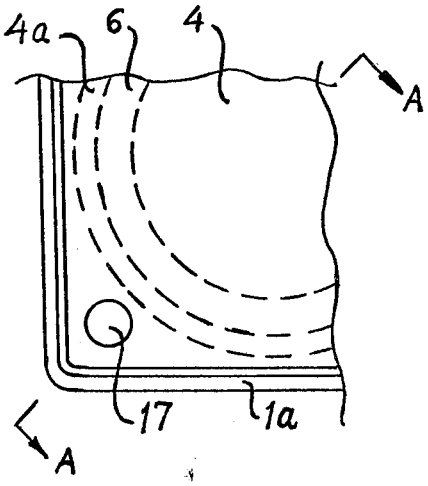
FIG. 5 is a partial plan view of still another embodiment of the invention, with the cover removed.
Figure 6:
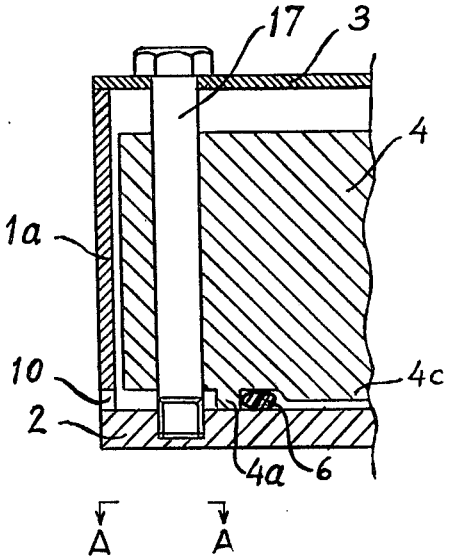
FIG. 6 is a section on line 6—6 of FIG. 5, with the cover in place.

FIGS. 5 and 6 show still another embodiment of the invention wherein the impact member, seen from above, is square. In this embodiment of the invention, the working member 4 is guided axially by four spindles 17, one in each corner of the working member, which are situated outside the flange 4a and the seal 6. Since the walls 1a do not guide the working member 4, there can be play between the walls and said member, eliminating requirements of machining and of a good fit between the walls and the working member. The walls 1a need not be fluid-tight but may for example consist of a number of ribs or bars extending upwards from the plate 2. As shown in FIG. 6, in this embodiment the working member 4 has a portion 4c extending downwards towards the plate 2 inside the seal 6, thus reducing the height of the cavity 5, and thereby reducing its volume. This causes the air pressure in the cavity to rise more quickly when, during the movement of the working member towards the plate, the seal 6 begins to seal against said plate, and will thus improve the cushioning of the impact against the plate.

As is easily seen from the embodiments shown in FIGS. 1, 4, 5 and 6, the present invention permits great freedom in the design of the working member or plunger and in the arrangement of the axial guide means. It is, for example, possible to make the working member an elongate rectangle, seen from above, with a guide spindle inside each short end of it and on the outside of a seal located between the spindles. In such a long rectangular surface it would also be possible to arrange three spindles, one in the middle and one at each end, with a ring-shaped seal between the first and the second spindle and another such seal between the second and the third. Instead of guide spindles it would also be possible to use other guide means, for example in the form of guide bars or the like engaging in grooves in the sides of the plunger.

A great advantage of the present invention is that no sealing is required between the plunger 4 and the cylinder walls or other axial guiding means for the plunger, since the air pressure acts only inside the flange 4a, or between the flanges 4*a* and 4*b*. The plunger or working member and its axially guiding means need therebefore only be made with the amount of accuracy needed for the purpose of guiding. Moreover, there is no strong overpressure tending to force away the lubricant which is suitably used between plunger and guiding means. Also, since the pressure acts only in the cavity 5, which is continuously cleaned by the exhaust air, the device will be totally insensitive to contaminants in the incoming air.

FIG. 10 shows another impact mechanism according to the invention wherein the working member or plunger 4 is connected to a rod 18 for transmitting the reciprocating movement of the working member to a chisel, for example, or to another tool or device. In this case the working member is built into a housing 1 corresponding to the cylinder 1 in FIG. 1. The housing consists of two parts, one with a plate 2 and the other one with walls 1*a* surrounding the working member, the parts having threaded portions matching each other and being screwed together. The conduit 8 for the pressure medium passes not through the working member but through the plate 2. Exhaust of the pressure medium when the seal 6 opens is accomplished through a clearance or drilled ducts between the working member and the walls 1*a*, and through outlet openings 10 parallel to the rod 18.

The seals used for different applications of the invention can be of varying design. For small devices, such as a chiseling tool substantially in accordance with FIG. 10 and a marking stylus which is also driven in the way shown in FIG. 10, ordinary rubber O-rings have been used with good results. Plastic cords with round cross-section, welded together into rings, have also been tried and have proved to function. For larger hammering or pile-driving devices substantially in accordance with FIG. 1, rubber hose of the ordinary garden hose type has been used with good results.

If a seal ring or hose having a round or substantially round cross section is used, the axial thickness of the seal in its relaxed or unloaded condition should be somewhat less than twice the height of the flange 4*a*. If the ring is made thicker than this, in an effort to maintain sealing between the ring and the plate 2 for a longer distance during the lifting movement of the working member or plunger, there is a risk of the ring being forced out by the air pressure so that it will jam between the flange 4*a* and the plate 2 when the plunger returns towards the plate.

The seal 6 can also be made otherwise than in the form of a ring or hose with round cross-section. What is essential is that it is designed and fitted in such a way that it can be compressed to a suitable height when the working member or plunger 4 is in the position closest to the plate 2 and that, due to the action of the pressure medium, it can be deformed to achieve a greater axial height to maintain the seal before, during the upward movement of the plunger, it loses contact with the plate and springs back, or pressed back by the pressure medium, to a smaller height.

Figure 7:
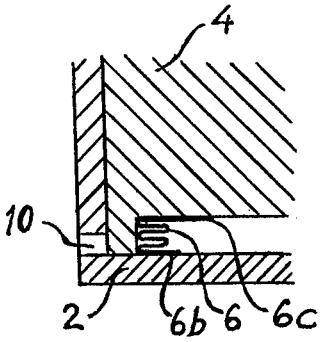
FIGS. 7, 8 and 9 are partial sectional elevations showing various stages of operation for another sealing arrangement in accordance with the present invention.
Figure 8:
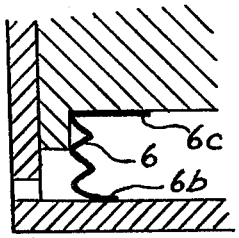
Figure 9:
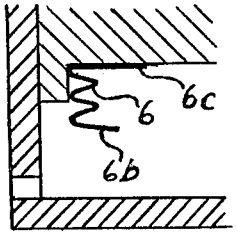

An example of a variant design of the seal 6 is shown in FIGS. 7–9. In this example the seal is made in the form of a bellows with a series of accordian folds. The surface of the outermost fold 6*b* of the bellows, which is in contact with the plate 2, is larger than the surface of each of the central folds of the bellows. The innermost fold 6*c*, which is in contact with the bottom side of the working member, has an even larger surface than the fold portion 6*b* and can also be made in the form of an end wall completely closing one end of the bellows. Due to the action of the pressure medium on the enlarged portions 6*b* and 6*c*, which offer a larger pressure surface than the other portions, the portion 6*c* will be pressed against the bottom side of the working member and the portion 6*b* will be pressed against the plate 2 while the bellows is extended during the first phase of the upward movement of the plunger. When the plunger 4 has reached a certain axial position, the bellows portion 6*b* is torn loose from the plate 2 and the bellows contracts into a relaxed mean position to allow quick exhaust of the pressure medium. A bellows seal of this type makes it possible to obtain a larger pulsating movement of the seal than when the seal is made in the form of a hose or the like, and thus achieves a longer working stroke of the plunger 4.

FIGS. 11 and 12 show further examples of seals 6. These seals are not made in the form of open rings but have a bottom wall or plate 6*c* connected to the ring-shaped outer portion. Through this feature, the seals are held in position against the working member 4 by the pressure medium, so that there will be no problem to fit them so that they stay in place. The seals also are mounted on a flanged plate 19, in order not to be restricted to a given flange height of the plunger or working member to which the seals are to be fitted. Moreover, the seal 6 shown in FIG. 11 is shaped, in cross-section, as a lug inclined inwards toward the pressure cavity or chamber, to obtain a large axial deformation of the seal as the lug straightens outwardly upon the application of fluid pressure.

When the plunger or working member 4 falls or by spring pressure is thrown back towards the plate 2, it will be braked by the increasing air pressure and also by the resistance of the seal 6 as it is compressed, so that there are no hard blows against the plate 2. The degree of cushioning can be adjusted by suitably relating the weight of the plunger or working member on the one hand, and the pressure surface under it, the air pressure and the admitted amount of air per time unit on the other hand. Adjustment can also be made by changing the pre-tension of the spring 13. The thickness and hardness of the seal 6 and the height of a shim 7 if used (FIG. 2), are other factors which have an influence on cushioning. The shim 7, as shown in FIG. 2, increases the amount of compression of the seal, resulting in an increased sealing distance during the movement of the plunger, which affects both the stroke length and the cushioning distance.

Still another way of affecting the cushioning is shown in FIG. 6. As mentioned above, the volume of the cavity 5 under the working member 4 is reduced in FIG. 6 by providing the working member with a portion 4*c* extending downward, which causes the air pressure to increase more quickly once the cavity is closed by the seal 6.

For embodiments of the invention, such as shown in FIG. 10, where the output impact of the working member or plunger 4 is delivered not via the plate 2 but via a rod 18 or the like connected to the opposite end of the plunger, it is suitable to make the plunger light in relation to the housing 1, since the housing is to counterweight the movements of the plunger and the rod. When the output is received via the bottom plate 2, on the other hand, the plunger should be heavy in relation to the housing.

The output force delivered by a device substantially in accordance with FIG. 10 at a given air pressure is of course dependent on the size of the pressure surface of the working member or plunger. In the case of hand tools, for example, which for reasons of handling convenience or other reasons should have a small outer diameter, it may be unsuitable to increase the pressure surface by increasing the plunger's diameter. In this case it is possible to increase the output by making a device similar to the device shown in FIG. 10 but in multiple "stories", i.e., with two or more plungers 4 in cavities arranged one after the other in the housing 1, the plungers being arranged along the length of and engaging on the same rod 18, with air from a common pressure source being supplied through each plate 2.

In the various embodiments of the invention illustrated in the drawings, the seal 6 and its supporting flange 4*a* are shown provided on the plunger or working member 4. It is also possible to make the bottom of the plunger smooth and provide a seal and a supporting flange on the plate 2. It is also possible, as shown in FIG. 11, to have the flange in a loose plate 19 carrying the seal and attached to the working member or plate 2. Additionally, there is the possibility of providing two sets of flanges and seals, facing each other, on the plunger and the plate 2, to obtain a longer stroke and improved cushioning.

Actual trials have shown that the principles of construction which characterize devices in accordance with the invention, i.e., an elastic seal fitted at one end of the working member or plunger and pulsating during operation, can be applied to varying sizes of devices. It is possible to make devices as small as a marking stylus and as large as a pile driver, and to vary frequency and stroke length within very wide limits.

For example, a first prototype of a device in accordance with the invention was made in the form of a flanged plate corresponding to a working member 4 having a low height. No special bottom plate 2 was used, but the device was put directly on a flat concrete floor. The flanged plate was loaded with weights totalling 1.5 tons. For a seal inside the flange a relatively robust rubber hose was used. The device was driven from a compressed air source delivering a pressure of 7 $kp/cm^2$, and the pressure surface under the plate gave a lifting force, at said pressure, of approximately 20 tons. The flanged plate proved to operate with a stroke length of approximately 10 mm and a frequency of 4–5 strokes per second. It operated without hard blows against the floor and, since the air could escape around the whole circumference of the plate, with a low noise from the exhaust air.

A second prototype, made in accordance with FIG. 1, has been tested both with and without a pressure spring 13. In this case, too, a rubber hose was used for a seal. The plunger diameter was approximately 175 mm. When the device was tested without the spring it had a frequency of approximately 5 strokes per second. The mode of operation did not change noticeably when the plunger, which originally weighed approximately 30 kg, was weighted further to approximately 100 kg. The stroke length was approximately 10 mm. When the device was tried with a spring fitted between the plunger and the cover 3, the frequency increased to a several times higher value. The frequency will increase with increasing pre-tensioning of the spring, up to a point where the counter-pressure is so strong that the device will no longer function.

A third prototype was made substantially in accordance with FIG. 10 and was fitted with a chisel at the end of the rod 18. The pressure surface under the plunger 4 gave an operating force of approximately 90 kp. The seal 6 consisted of an ordinary O-ring, 8 mm thick. The stroke length was approximately 4 mm and the frequency approximately 150 strokes per second. It proved possible to make relatively deep cuts with the chisel along the edge of a 4 mm steel plate and, for example, to countersink, to a depth of several millimeters, the edges of holes drilled in the plate.

The above-mentioned third prototype, made mainly in accordance with FIG. 10, was fitted with a seal in the form of an O-ring which was only placed inside the flange 4*a* and was not in any way fixed to the flange or the working member 4. When observing the mode of operation of the device with the help of a stroboscope, through slots made in the side of the housing opposite to the operating area of the flange and the seal, it was noted that the seal 6 did not always rest against the end of the plunger 4, inside the flange, but seemed to be "floating" between the plunger and the plate 2, pulsating rapidly. Despite this, the device was functioning excellently, even though compared to a device with the seal fastened in place, it emitted a secondary noise, probably caused by the passage of air between the flange and the outer side of the seal when the seal moved away from the plunger. This observation indicates that it would also be possible to fix the seal on the plate 2, so that the flange 4*a* of the plunger alternately slides over the seal and moves away from it. A disadvantage possibly resulting would, however, be wear due to the friction between flange and seal.

Finally, a fourth prototype was made in the form of a marking stylus fitted with a needle corresponding to the rod 18 in FIG. 10 and a plunger, seal and spring arranged in the same way as in this figure. The plunger diameter was 12 mm, and for a seal an O-ring with an outer diameter of 10 mm and a thickness of 1.7 mm was used. The frequency was measured to be approximately 350 strokes per second, and the stroke length a few tenths of a millimeter. The stylus functioned as an excellent marking tool, with which marking could be carried out in glass and steel—even high-speed tool steel—quickly and with deep and distinct marks, almost as unimpededly as when writing with an ordinary pen on paper.

Particularly in the case of a very small device, such as a marking stylus, it might be possible to make plunger and seal in one piece, of plastic for example, or another elastic material. In such a device, the flange portion could be given such a form as to provide both radial support and the necessary sealing, the pressure medium producing a very small pulsation in the material, which could be sufficient for such small, high-frequency devices.

The above-mentioned prototypes were driven only at one end of the plunger, which was returned either by gravity or a springing action. Returning the plunger could, however, also be done in a double acting device by supplying the pressure medium also to its opposite end. This could for example be accomplished in such a way that at this opposite end of the plunger a seal, a flange and a plate of the kind described above were also provided. The available axial distance of travel of the plunger should be so adjusted that during the final phase of the plunger's movement away from one plate it would cause sealing and compression against the other plate, and vice versa. In order to prevent the plunger stopping at a dead point between the plates, it could in its idle position be held against one of them by an auxiliary spring.

Although specific embodiments of the invention have been disclosed herein in detail, it is to be understood that this is for the purpose of illustrating the invention, and should not be construed as necessarily limiting the invention, since it is apparent that many changes can be made to the disclosed structures by those skilled in the art to suit particular applications.

We claim:

1. A fluid pressure operated impact mechanism comprising:

a. a plunger member and a stop member mounted to move towards and away from one another along an aligned axis in face-to-face relationship to deliver a succession of blows to a percussion tool or the like connected to one of said members;

b. annular flange means provided on one of said members effective to form a pressure chamber in an interface region between said members during reciprocating movement thereof;

c. means for supplying a pressure medium to said pressure chamber to exert a separating force between said members;

d. elastic deformable means arranged in said pressure chamber to be compressed axially between said members and pressed radially against said flange means by the force of the pressure medium during the movement of said members toward one another to seal said pressure chamber until the pressure therein attains a force effective to cause said members to separate and to restore said elastic means to its relaxed form during the separating movement; and e. venting means for automatically venting pressure medium from said pressure chamber during that portion of said toward and away movement when said pressure chamber becomes unsealed by said elastic means.

2. A fluid pressure operated impact mechanism as claimed in claim 1, wherein the elastically deformable sealing means has an axial dimension, when relaxed, that is greater than the axial dimension of said annular flange means but less than twice the axial dimension of the flange means.

3. A fluid pressure operated impact mechanism as claimed in claim 2 wherein the elastically deformable sealing means has a relaxed axial dimension substantially twice the axial height of the support wall, whereby a substantial amount of axial deformation of the sealing means may take place, without forcing the sealing means away from the support wall.

4. A fluid pressure operated impact mechanism as claimed in claim 1 wherein the pressure chamber forms a single peripheral separating line, and the sealing means comprises a single sealing member extending along the separating line.

5. A fluid pressure impact mechanism as claimed in claim 1 wherein the pressure chamber is formed with additional flange means surrounding a central shaft for axially guiding one of said members, and wherein additional sealing means are provided to press against said additional flange means.

6. A fluid pressure operated impact mechanism as claimed in claim 1 wherein the elastically deformable sealing means has, in its relaxed condition, a circular cross section.

7. A fluid pressure operated impact mechanism as claimed in claim 6 wherein the sealing means is tubular.

8. A fluid pressure operated impact mechanism as claimed in claim 1 wherein the sealing means comprises an integral base plate resting in the pressure chamber.

9. A fluid pressure operated impact mechanism as claimed in claim 1 wherein the sealing means comprises an axially extending bellows.

10. A fluid pressure operated impact mechanism as claimed in claim 9 wherein the outer fold of the bellows has a larger surface area than the other folds, thereby to hold the outer fold in sealing engagement by means of forces exerted by the pressure medium.

* * * * *